United States Patent [19]

Balson

[11] 3,986,847

[45] Oct. 19, 1976

[54] VITREOUS BONDED CUBIC BORON NITRIDE ABRASIVE ARTICLES

[75] Inventor: Peter Charles Balson, Goshen, Ohio

[73] Assignee: Cincinnati Millacron, Inc., Cincinnati, Ohio

[22] Filed: Apr. 7, 1975

[21] Appl. No.: 565,518

Related U.S. Application Data

[63] Continuation of Ser. No. 370,385, June 15, 1973, abandoned.

[52] U.S. Cl. ..... 51/308; 51/295; 51/307

[51] Int. Cl.[2] ..... B24D 3/14; C04B 31/16

[58] Field of Search ..... 51/308, 295, 307

[56] References Cited

UNITED STATES PATENTS

| | | | |
|---|---|---|---|
| 3,528,789 | 9/1970 | Mathewson et al. | 51/307 |
| 3,554,717 | 1/1971 | Shaffer et al. | 51/309 |
| 3,576,610 | 4/1971 | Mathewson | 51/308 |
| 3,743,489 | 7/1973 | Wentorf, Jr. et al. | 51/308 |
| 3,852,049 | 12/1974 | Hibbs et al. | 51/308 |

FOREIGN PATENTS OR APPLICATIONS

| | | | |
|---|---|---|---|
| 1,296,589 | 11/1972 | United Kingdom | 51/308 |

*Primary Examiner*—Donald J. Arnold
*Attorney, Agent, or Firm*—Donald Dunn

[57] ABSTRACT

A vitreous bonded cubic boron nitride grinding wheel is provided which optionally contains silicon carbide or other abrasive having a coefficient of thermal expansion substantially the same as the coefficient of thermal expansion of cubic boron nitride, and wherein the vitreous bond, having a coefficient of thermal expansion substantially the same as the coefficient of thermal expansion of cubic boron nitride, is substantially non-reactive with cubic boron nitride and the optional abrasive.

6 Claims, No Drawings

VITREOUS BONDED CUBIC BORON NITRIDE ABRASIVE ARTICLES

This is a continuation of application Ser. No. 370,385 filed June 15, 1973 and now abandoned.

BACKGROUND OF THE INVENTION

This invention relates to vitreous bonded cubic boron nitride abrasive articles and, in particular, to vitreous bonded cubic boron nitride grinding wheels.

Since the invention of cubic boron nitride it has been known in the art to use cubic boron nitride as an abrasive in grinding wheels. The hardness, strength and other properties of cubic boron nitride have made it a desirable, although expensive, abrasive for grinding wheel applications. Notwithstanding its expensive nature, cubic boron nitride has been found to be useful in the grinding of metals and other hard materials. Thus cubic nitride has been incorporated into metal bonded, organic resin bonded and vitreous bonded grinding wheels.

In the grinding of metals and other hard materials, such as metal carbides, it is highly important that the grinding wheel be strong, resist thermal shock, resist mechanical shock, exhibit low wear, hold shape, be free cutting; (i.e., resist being loaded up by the material being ground), have good grinding efficiency and exhibit good metal removal rate. All of these attributes are of particular importance in a grinding operation such as internal grinding of metal parts. It is, for example, particularly important in an internal grinding operation, such as the grinding of a bore in a metal part, that the grinding wheel maintain its shape for extended periods while exhibiting good strength, good grinding efficiency and good metal removal rate. Excessive and/or uneven wear of the grinding wheel causes out-of-tolerance dimensions and undesirable alteration of the shape of the workpiece being ground. Similar problems and requirements prevail in the contour grinding of metals with preshaped grinding wheels. As in internal grinding, contour grinding of metals with preshaped grinding wheels requires that the preshaped grinding wheel retain its initial configuration for long periods while having good grinding efficiency and metal removal rate. Of course, these desirable attributes of the grinding wheels apply to all types of grinding to varying degrees. In some types of grinding critical retention of grinding wheel shape is not as important as in other types of grinding, however, all grinding wheels desirably must have the attributes which render them efficient and economical in use.

Resin bonded cubic boron nitride grinding wheels have been found, commercially, to be unsatisfactory in strenuous, high precision grinding operations, such as internal grinding or contour grinding, because they readily lose their shape and have poor resistance to high temperatures often encountered under strenuous grinding conditions. Metal bonded cubic boron nitride grinding wheels are expensive and their use in the commercial grinding art has been confined principally to grinding very hard materials such as metal carbide cutting tool elements.

The high coefficient of expansion of the metal bond and the affinity toward loading have made the metal bonded cubic boron nitride grinding wheel undesirable for use in grinding metal for extended grinding periods under strenuous conditions, and exhibit poor cutting rates. Vitreous bonded cubic boron nitride grinding wheels have enjoyed only limited success in commercial metal grinding operations, especially wherein the grinding wheel is subjected to high mechanical and thermal shock, and required to maintain its shape over extended periods under strenuous grinding conditions. Bond failure, with subsequent loss of the cubic boron nitride abrasive grain, appear to be the principle cause for the poor performance of vitreous bonded cubic boron nitride grinding wheels under high thermal and mechanical shock grinding conditions. Additionally, it is known that the prior art vitreous bonded cubic boron nitride grinding wheels exhibit low grinding efficiency for many types of metals and often require relatively high grinding pressure or force to achieve grinding action.

It is desirable that in a vitreous bonded cubic boron nitride abrasive article, such as a grinding wheel, that it be free grinding (i.e., resist loading), grind at low grinding pressures, have good adhesion between the bond phase and the cubic born nitride so as to resist rapid or premature breaking out of the cubic boron nitride grain with subsequent rapid wear of the wheel and loss of its shape, be resistant to mechanical and thermal shock and have good grinding efficiency. The prior art vitreous bonded cubic boron nitride abrasive articles (e.g., grinding wheels) have been found wanting in one or more of the aforementioned properties.

It is an object of this invention to provide an improved vitreous bonded cubic boron nitride abrasive article.

It is another object of this invention to provide a vitreous bonded cubic boron nitride abrasive article which avoids many, if not all, of the disadvantages and undesirable features of prior art vitreous bonded cubic boron nitride abrasive articles.

It is further object of this invention to provide a vitreous cubic boron nitride grinding wheel with improved grinding efficiency, improved resistance to mechanical and thermal shock and improved retention of shape.

These and other objects of this invention will be made clear in the following description and examples of the invention.

DESCRIPTION OF INVENTION

In accordance with the present invention I have discovered that the aforementioned objects and others can be achieved by an abrasive article, such as a grinding wheel, having an abrasive section comprising I. as the abrasive phase cubic boron nitride abrasive and from 0 to 90% of the total volume of the abrasive phase of a second abrasive grain having a coefficient of thermal expansion substantially the same as the coefficient of thermal expansion of cubic boron nitride, and II. as a vitreous bond bonding said abrasive phase, a vitreous bond having a coefficient of thermal expansion substantially the same as the coefficient of thermal expansion of cubic boron nitride and being substantially non-reactive with the cubic boron nitride abrasive grain and the said second abrasive grain characterized in that on the surface of the cubic boron nitride abrasive grain interfacing said vitreous bond there shall have been chemically formed thereon a thin, adherent boric oxide layer.

In the grinding of metals the grinding wheels of this invention exhibit high resistance to thermal and mechanical shock during grinding, good grinding efficiency and high retention of shape during grinding. Although one embodiment of this invention is to employ cubic boron nitride as the sole abrasive grain, another and often preferred embodiment of this invention is to employ cubic boron nitride abrasive grain in combination with silicon carbide abrasive grain as the second abrasive grain. In other embodiments of this invention I may employ, in combination with cubic boron nitride, other second abrasive grains having coefficient of thermal expansion substantially the same as the coefficient of thermal expansion of cubic boron nitride. I recognize that the efficient and effective grinding of various metals or other hard materials often calls for the use of different second abrasive grains in combination with cubic boron nitride abrasive grain in the practice of this invention, and that the amount and nature of the specific second abrasive grain used in combination with cubic boron nitride abrasive, can often be dictated by the metal or other hard material to be ground. Thus, various embodiments of this invention may be practiced by those skilled in the art of grinding without departing from the spirit and scope of my invention. In the abrasive articles of my invention the abrasive phase is the abrasive grains present therein.

In accordance with my invention I have found that vitreous bonded cubic boron nitride abrasive articles, such as grinding wheels, being improved and lacking the disadvantages of the prior art vitreous bonded cubic boron nitride grinding wheels are provided when on the surface of the cubic boron nitride interfacing the vitreous bond there is chemically formed prior to or concurrently with the formation of the vitreous bond a thin, strongly adherent boric oxide layer.

It is known in the cubic boron nitride abrasive prior art that boric oxide forms on the surface of cubic boron nitride. An excessive boric oxide layer is detrimental to grinding and weakens or prevents adherence of a vitreous bond to the cubic boron nitride abrasive. To overcome the latter disadvantage and prevent the formation of the boric oxide the prior art teaches the manufacture of vitreous bonded cubic boron nitride articles in a reducing atmosphere or under conditions which inhibit or prevent boric oxide formation. Contrary to the teachings of the prior art, I have discovered that a thin, strongly adherent boric oxide layer chemically formed on the surface of the cubic boron nitride abrasive grain, such as by reaction of the surface of said cubic boron nitride with oxygen or air, results in strong bonding between the vitreous bond phase and the cubic boron nitride abrasive grain resulting in vitrified bonded cubic boron nitride grinding wheels superior to the prior art grinding wheels. The thin, strongly adherent boric oxide layer chemically formed on the surface of the cubic boron nitride abrasive grain in the practice of this invention may be formed prior to or concurrently with the formation of the grinding wheel and is of such thickness that said boric oxide layer is entirely adherent to the cubic boron nitride abrasive and does not alter the physical properties or structure of the cubic boron nitride. Further, the thin, strongly adherent boric oxide layer is of such thickness that there is absent loosely bound boric oxide such as would readily detach from said layer.

The cubic boron nitride used in the practice of this invention is the cubic crystal structure boron nitride having a zinc blend cubic structure and a hardness approaching the hardness of diamond. The cubic crystal structure boron nitride is disclosed in U.S. Pat. No. 2,947,617, issued Aug. 2, 1960 to Robert H. Wentorf, Jr., which disclosure is incorporated herein by reference. Cubic boron nitride grain is frequently referred to in the art as "Borazon" which term is a registered trademark of the General Electric Company for cubic boron nitride abrasive grain. The cubic boron nitride abrasive grain employed in the practice of this invention embraces the cubic boron nitride descriptively termed in the art as "Borazon" and the single and aggregate crystal state of cubic boron nitride.

In accordance with my invention there may be optionally employed another abrasive grain in combination with the cubic boron nitride abrasive grain. Further, in accordance with my invention the said second abrasive grain must have a coefficient of thermal expansion substantially the same as the coefficient of thermal expansion of cubic boron nitride. As examples of the said optional abrasive grain usable in the practice of this invention there is included, but not limited to, silicon carbide, tungsten carbide, titanium carbide, boron carbide, zirconium carbide, tungsten boride, titanium boride, zirconium boride, tungsten nitride, titanium nitride, and zirconium nitride.

In the practice of this invention it is required that the second abrasive grain and that the vitreous bond have a coefficient of thermal expansion substantially the same as the coefficient of thermal expansion of cubic boron nitride. In the context of this invention as heretofor and hereafter employed, the term coefficient of thermal expansion means the coefficient of volume expansion. The definition of and formulae for calculating the coefficient of volume expansion may be found in standard reference textbooks on physics, chemistry, mechanical engineering and chemical engineering such as the Handbook of Chemistry and Physics, 45th Edition, published by the Chemical Rubber Company.

While to achieve the advantages of the abrasive articles of this invention it may be most desirable to employ in the practice of this invention as a second abrasive grain an abrasive grain having a coefficient of thermal expansion the same as or very nearly the same as the coefficient of thermal expansion of cubic boron nitride alternatively there may be employed with great effectiveness as a second abrasive grain an abrasive grain having a coefficient of thermal expansion somewhat, although not considerably, different from the coefficient of thermal expansion of cubic boron nitride.

In a preferred embodiment of my invention silicon carbide abrasive grain is employed as the optional abrasive along with the cubic boron nitride abrasive. The vitreous bonded cubic boron nitride abrasive articles of my invention may contain cubic boron nitride abrasive as the sole abrasive or may contain up to about 90% of the total volume of the abrasive phase of the second abrasive grain. Thus, with respect to the abrasive grain phase there may be present, based on the total volume of abrasive phase 10 to 100% by volume of cubic boron nitride abrasive grain and 0 to 90% by volume of the second abrasive grain.

The cubic boron nitride abrasive grain and the second abrasive grain used in combination with the cubic boron nitride employed in the practice of this invention may be of a grit size commonly known in the art for use in abrasive articles.

In accordance with my invention the cubic boron nitride abrasive grain and the second abrasive grain are bonded by a vitreous bond to form the abrasive article. This vitreous bond is a glassy bond which in accordance with this invention must have a coefficient of thermal expansion substantially the same as the coefficient of thermal expansion of cubic boron nitride and be substantially non-reactive with the cubic boron nitride and the second abrasive grain which may be employed in combination with the cubic boron nitride abrasive grain. Vitreous bond which, during formation, react with the cubic boron nitride and the optional abrasive grain so as to weaken and destroy or otherwise interfere with the abrading ability of the cubic boron nitride and the optional abrasive grain and/or by virtue of said reaction exhibit weak or little or no bonding power to the cubic boron nitride and optional abrasive grain therefore are to be excluded from the practice of this invention. The vitreous bonds employed in this invention are vitreous bonds which during formation do not react with cubic boron nitride abrasive grain and the optional abrasive grain so as to (a) weaken and destroy or otherwise interfere with the abrading ability of the cubic boron nitride and optional abrasive grain, and/or (b) exhibit little or no bonding power to said cubic boron nitride and optional abrasive grains. In the practice of my invention there is employed a vitreous bond having a coefficient of thermal expansion substantially the same as the coefficient of thermal expansion of cubic boron nitride and which thereby contributes to the thermal expansion homogeneity and improved resistance to thermal and mechanical shock of the abrasive article of this invention. Desirably, thorough bond vitrification should occur without the use of excessively high temperatures or prolonged firing periods. The vitreous bonds usable in the practice of this invention are vitreous bonds which are mature at a temperature up to and including 1800° F. in an oxidizing atmosphere. Those skilled in the art can within the spirit and scope of this invention readily formulate vitreous bonds usable in the practice of this invention. This invention should not be construed as covering the compositions of the vitreous bonds usable in the practice of this invention.

There may be employed in the abrasive articles of this invention materials known in the art which aid in the manufacture of said abrasive articles and/or act as grinding aids provided said materials do not significantly alter the coefficient of thermal expansion of the bond so as to render the coefficient of thermal expansion of the bond not substantially the same as the thermal coefficient of expansion of cubic boron nitride and do not substantially react with the cubic boron nitride and the second abrasive of the said abrasive articles.

Among the abrasive articles of this invention there are contemplated grinding wheels of the shapes commonly known to the art, such as the commonly known disc, dish and cup shapes and others. Within the various shapes contemplated there is also contemplated abrasive articles wherein the abrasive elements or grains are located principally if not exclusively in a peripheral layer, which peripheral layer performs the grinding operation. Thus, as an example of an abrasive article contemplated within the scope of this invention there is a disc shape grinding wheel having (1) located at its circumference a layer comprising I. cubic boron nitride abrasive and from 0 to 90% of the total volume of the abrasive phase of a second abrasive having a coefficient of thermal expansion substantially the same as the coefficient of thermal expansion of cubic boron nitride, and II. as the vitreous bond bonding said abrasive phase a vitreous bond having a coefficient of thermal expansion substantially the same as the coefficient of thermal expansion of cubic boron nitride and being substantially non-reactive with cubic boron nitride and the said second abrasive grain characterized in that the on surface of the cubic boron nitride abrasive grain interfacing said vitreous bond there shall have been chemically formed thereon prior to or concurrently with the formation of said vitrified bond a thin, adherent boric oxide layer, and (2) a cubic boron nitride absent vitrified core supporting said circumferential layer, said vitrified core having a coefficient of thermal expansion substantially the same as the coefficient of thermal expansion of cubic boron nitride. There is contemplated as a further example a disc shaped grinding wheel within the scope of this invention wherein the cubic boron nitride and optional abrasive grain are distributed throughout the volume of the said grinding wheel.

The abrasive articles of this invention may be of hardness grades commonly known to the vitrified grinding wheel art. Thus, as is commonly known in the art the volume of vitreous bond, volume of abrasive and volume of porosity may be varied in an abrasive article so to achieve various hardness grades.

Many methods commonly known in the art for making vitreous bonded abrasive articles, such as grinding wheels, may be employed in making the vitreous bonded cubic born nitride abrasive articles of this invention. Thus, as an example of one method which may be used to make the abrasive articles of this invention cubic boron nitride abrasive grain, silicon carbide abrasive grain and the vitreous bond are thoroughly blended together, said blend placed in a suitable mold and pressed where after the said pressed article is fired in the presence of air and at a temperature of up to and including 1800° F, preferably 1000° to 1600° F. to form the abrasive article. In the practice of this invention vitrification and maturing of the vitreous bond must occur at temperatures up to and including 1800° F. Further, it is required in the making of the abrasive articles of this invention that said abrasive articles be formed under time, temperature up to and including 1800° F. and atmospheric conditions which do not result in the formation of excessive amounts of boric oxide on the surface of the cubic boron nitride, while at the same time permitting formation of a thin, strongly adherent layer of boric oxide on the surface of the cubic boron nitride.

EXAMPLES

The following examples are presented to illustrate this invention and the practice thereof and are not intended as any limitation of this invention. In the following examples the amounts shown are parts by weight unless otherwise indicated.

EXAMPLE 1

| Formulation | |
|---|---|
| Cubic boron nitride (Borazon I) 170/200 grit | 37.88 wt. % |
| Black silicon carbide 180 grit | 34.85 wt. % |
| Bond | 19.44 wt. % |
| 50% by weight solids aqueous paraffin wax emulsion | 7.83 wt. % |

The bond used in the above formulation had essentially the following composition expressed as the oxides: $K_2O$ 1.0, $Na_2O$ 1.0, $Al_2O_3$ 2.0, $B_2O_3$ 26.0 and $SiO_2$ 70.0

Cubic boron nitride: Silicon carbide (by volume) = 50:50

PROCEDURE

The cubic boron nitride and silicon carbide were blended and then the 50% by weight solids aqueous paraffin wax emulsion added and mixed into the blend of cubic boron nitride and silicon carbide. The bond was then added and thoroughly mixed into the blend and the resultant mixture was then dried in an oven at 105° F. to essentially remove the water from the mixture. Upon being removed from the oven, the dried mixture was broken up by passing it through a 45 mesh sieve. The required amount of the dried, particulate mixture was then placed in a suitable mold, the completely assembled mold placed in a press and the wheel pressed to the desired size and shape. The wheel, upon being removed from the mold, was then fired in an oxidizing atmosphere (i.e., air) by heating at the rate of 300° F./hour until a temperature of 1525° F. was reached and then maintaining the 1525° F. temperature for 3 hours.

EXAMPLE 2

| Formulation | |
|---|---|
| Cubic boron nitride (Borazon I) 170/200 grit | 37.69 wt. % |
| Black silicon carbide 180 grit | 34.68 wt. % |
| Bond | 19.83 wt. % |
| 50% by weight solids aqueous paraffin wax emulsion | 7.80 wt. % |

The bond used in the above formulation had essentially the following composition expressed as the oxides: $K_2O$ 1.0, $Na_2O$ 1.0, $Li_2O$ 0.5, ZnO 2.0, CaO 1.1, MgO 7.2, $Al_2O_3$ 8.7, $B_2O_3$ 27.0 and $SiO_2$ 51.5.

Cubic boron nitride: Silicon carbide (by volume) = 50:50

PROCEDURE

Same as in Example 1.

EXAMPLE 3

| Formulation | |
|---|---|
| Cubic boron nitride (Borazon I) 170/200 grit | 35.85 wt. % |
| Black silicon carbide 180 grit | 36.93 wt. % |
| Bond | 19.81 wt. % |
| 50% by weight solids aqueous paraffin wax emulsion | 7.41 wt. % |

The bond used in the above formulation was of the same composition as used in Example 2.

Cubic boron nitride: Silicon carbide (by volume) = 47.4/52.6

PROCEDURE

Same as in Example 1.

EXAMPLE 4

| Formulation | |
|---|---|
| Cubic boron nitride (Borazon I) 170/200 grit | 36.26 wt. % |
| Black silicon carbide 180 grit | 33.36 wt. % |
| Bond | 22.88 wt. % |
| 50% by weight solids aqueous paraffin wax emulsion | 7.50 wt. % |

The bond used in the above formulation was of the same composition as used in Example 2.

Cubic boron nitride: Silicon carbide (by volume) = 50:50

PROCEDURE

Same as in Example 1.

EXAMPLE 5

| Formulation | |
|---|---|
| Cubic boron nitride (Borazon I) 170/200 grit | 36.26 wt. % |
| Black silicon carbide 4F grit | 33.36 wt. % |
| Bond | 22.88 wt. % |
| 50% by weight solids aqueous paraffin wax emulsion | 7.50 wt. % |

The bond used in the above formulation was of the same composition as used in Example 2.

Cubic boron nitride: Silicon carbide (by volume) = 50:50

PROCEDURE

Same as in Example 1.

EXAMPLE 6

| Formulation | |
|---|---|
| Cubic boron nitride (Borazon I) 140/170 grit | 36.83 wt. % |
| Black silicon carbide 170/200 grit | 37.94 wt. % |
| Bond | 20.35 wt. % |
| 5417 BRP Resin | 4.88 wt. % |

The bond used in the above formulation was of the same composition as used in Example 2.

The 5417 BRP Resin is a phenolic resin obtainable from the Union Carbide Corp.

Cubic boron nitride: Silicon carbide (by volume) = 47.4/52.6

PROCEDURE

The cubic boron nitride and silicon carbide were thoroughly blended together and then the bond added and thoroughly blended in, after which the 5417 BRP resin was added and thoroughly blended in. The required amount of the resultant homogenous mixture was then charged to a suitable mold, the completely assembled mold placed in a heated press and the wheel pressed at a mold temperature of 325° F. The mold was then cooled to about 275° F. and the wheel stripped from the mold, whereupon the wheel was then fired by heating in an oxidizing atmosphere (i.e., air) at a rate of 300° F./hour to a temperature of 1525° F. and then maintaining a temperature of 1525° F. for 3 hours.

EXAMPLE 7

| Formulation | |
|---|---|
| Cubic boron nitride (Borazon I) 140/170 grit | 36.83 wt. % |
| Black silicon carbide 170/200 grit | 18.97 wt. % |
| Black silicon carbide 4F grit | 18.97 wt. % |
| Bond | 20.35 wt. % |
| 5417 BRP Resin | 4.88 wt. % |

The bond used in the above formulation was of the same composition as used in Example 2.

Cubic boron nitride: Silicon carbide (by volume) = 47.4/52.6

PROCEDURE

Same as in Example 6.

EXAMPLE 8

| Formulation | |
|---|---|
| Cubic boron nitride (Borazon I) 170/200 grit | 59.25 wt. % |
| Black silicon carbide 180 grit | 13.63 wt. % |
| Bond | 19.47 wt. % |
| 50% by weight solids aqueous paraffix wax emulsion | 7.65 wt. % |

The bond used on the above formulation was of the same composition as used in Example 2.

Cubic boron nitride: Silicon carbide (by volume) = 80:20

PROCEDURE

Same as in Example 1.

EXAMPLE 9

| Formulation | |
|---|---|
| Cubic boron nitride (Borazon I) 170/200 grit | 15.44 wt. % |
| Black silicon carbide 180 grit | 56.46 wt. % |
| Bond | 20.17 wt. % |
| 50% by weight solids aqueous paraffin wax emulsion | 7.93 wt. % |

The bond used in the above formulation was of the same composition as used in Example 2.

Cubic boron nitride: Silicon carbide (by volume) = 20:80

PROCEDURE

Same as in Example 1.

EXAMPLE 10

| Formulation | |
|---|---|
| Cubic boron nitride (Borazon I) 170/200 grit | 42.98 wt. % |
| Black silicon carbide 180 grit | 30.05 wt. % |
| Bond | 18.08 wt. % |
| 50% by weight solids aqueous paraffin wax emulsion | 8.89 wt. % |

The bond used in the above formulation was of the same composition as used in Example 2.

Cubic boron nitride: Silicon carbide (by volume) = 56.8/43.2

PROCEDURE

Same as in Example 1.

EXAMPLE 11

In this example a 1.675 × 0.875 × 0.675 inch grinding wheel of this invention, made in accordance with Example 1, was compared to a comparable commercially available vitrified bonded cubic boron nitride grinding wheel in the internal bore grinding of 52100 steel bearings. When using a commercial aqueous based coolant, a wheel speed of 12,000 surface feet per minute (SFM) and a work speed of 300 to 500 SFM the aforementioned grinding wheel of this invention required a force to cut of 60 lbs. whereas the commercial wheel required a force of 110 lbs. to produce a cutting action. In the grinding of metals the higher the force required to cut the greater are the power requirements, power consumption, the temperature of the wheel and the temperature of the metal workpiece. The higher the temperature of the grinding wheel the greater is the susceptibility of the wheel to break down. The higher the temperature in metal workpiece during grinding the greater the distortion of said metal workpiece and the greater is the incidence of out-of-tolerance ground parts. Thus, lower cutting forces are desired and indeed advantageous in the grinding of metal, particularly in the precision grinding of metal, such as internal grinding.

EXAMPLE 12

In this lateral grinding test a conventional vitreous bonded aluminum oxide ($Al_2O_3$) abrasive grinding wheel was compared to the grinding wheel of Example 1 of this invention under the grinding conditions described in Example 11. The conventional vitrified bonded aluminum oxide grinding wheel yielded a production rate of 287 parts per hour whereas the vitreous bonded cubic boron nitride grinding wheel of Example 1 of this invention yielded a production rate of 300 parts per hour. Further, the wheel life of the conventional aluminum oxide grinding wheel was 500 parts (equivalent to 108 minutes) whereas, at comparable tolerances and surface finish, the wheel life of the grinding wheel of Example 1 of this invention was greater than 76,400 parts. The grinding wheel of Example 1 of this invention lasted more than 150 times as long as the conventional aluminum oxide grinding wheel. Such a marked increase in wheel life has distinct economic advantages for the vitrified bonded cubic boron nitride grinding wheel of this invention over the conventional vitreous bonded aluminum oxide grinding. As an example of such advantage, the vitreous bonded cubic boron nitride grinding wheel of Example 1 of this invention would require fewer changes, resulting in less down time for the grinder and greater production than the conventional vitreous bonded aluminum oxide grinding wheel.

EXAMPLE 13

In this example, the vitreous bonded cubic boron nitride grinding wheel of this invention described in Example 2, was compared to a commercially available vitreous bonded cubic boron nitride grinding wheel in the internal grinding of cast iron valve lifter bodies hardened to Rockwell C55 hardness. The following conditions were employed.

| | |
|---|---|
| Grinding Cycle Time | 6.5 – 7.0 seconds |
| Rough Grinding Rate | 0.15 $in^3$/min. in removing 0.011 inch of stock on the diameter |
| Coolant | Commercially available light oil |
| Wheel Size | 9/16 × 1/2 × 5/16 inch, and 9/16 × 3/8 × 5/16 inch pair |
| Wheel Speed | 7300 surface feet per minute (SFM) |
| Work Speed | 222 SFM |

The commercially available vitreous bonded cubic boron nitride grinding wheel could not be made to cut the cast iron, even at forces of at least 300 lbs. per inch of wheel width. The vitreous bonded cubic boron nitride grinding wheel of this invention, made in accordance with Example 2, cut at a force of about 60 pounds per inch of wheel width to produce quality parts in an acceptable cycle time.

EXAMPLE 14

Under the grinding conditions, described in Example 13, a commercially available vitreous bonded aluminum oxide abrasive grinding wheel was compared to the vitreous bonded cubic boron nitride grinding wheel of this invention, made in accordance with Example 2. The vitrified bonded aluminum oxide grinding wheel exhibited a wheel life of 167 parts whereas the grinding wheel of this invention, made in accordance with Example 2, exhibited a wheel life of 40,000 parts.

While these tests were all made on internal grinding operations, similar results are believed obtainable for other types of grinding. It is, therefore, to be understood that the present invention is not to be limited to internal grinding wheels, but is intended to cover grinding wheels for other types of grinding.

What is claimed is:

1. An improved abrasive article having an abrasive section comprising:

a. an abrasive phase 10 to 100% by volume of cubic boron nitride abrasive grain and from 0 to 90% of the total volume of the abrasive phase of a second abrasive grain having a coefficient of thermal expansion substantially the same as the coefficient of thermal expansion of cubic boron nitride, and b. a vitreous bond bonding said abrasive phase said bond having a coefficient of thermal expansion substantially the same as the coefficient of thermal expansion of cubic boron nitride and being substantially non-reactive with the cubic boron nitride abrasive grain and said second abrasive grain, characterized in that on the surface of the cubic boron nitride abrasive grain interfacing said vitreous bond there being chemically formed thereon a thin, adherent boric oxide layer in a thickness effective to promote a strong bond between said cubic boron nitride abrasive grains and said vitreous bond but less than that which would alter the structure or physical properties of said cubic boron nitride abrasive grains.

2. An improved abrasive article having an abrasive section comprising:

a. an abrasive phase of cubic boron nitride, and b. a vitreous bond bonding said abrasive phase said bond having a coefficient of thermal expansion substantially the same as the coefficient of thermal expansion of cubic boron nitride and being substantially non-reactive with the cubic boron nitride abrasive grain, characterized in that on the surface of the cubic boron nitride abrasive grain interfacing said vitreous bond there being chemically formed thereon a thin, adherent boric oxide layer in a thickness effective to promote a strong bond between said cubic boron nitride abrasive grain and said vitreous bond but less than that which would alter the structure or physical properties of said cubic boron nitride abrasive grains.

3. An improved abrasive article having an abrasive section comprising:

a. as the abrasive phase 10 to 100% by volume of cubic boron nitride and from 0 to 90% of the total volume of the abrasive phase of silicon carbide abrasive grain, and b. as a vitreous bond bonding said abrasive phase a vitreous bond having a coefficient of thermal expansion substantially the same as the coefficient of thermal expansion of cubic boron nitride and being substantially non-reactive with the cubic boron nitride abrasive grain and silicon carbide abrasive grain, characterized in that on the surface of the cubic boron nitride abrasive grain interfacing said vitreous bond there being chemically formed thereon a thin, adherent boric oxide layer in a thickness effective to promote a strong bond between said cubic boron nitride abrasive grains and said vitreous bond but less than that which would alter the structure or physical properties of said cubic boron nitride abrasive grains.

4. The abrasive article of claim 3 wherein as the said abrasive phase there is employed 50% of the total volume of the abrasive phase of cubic boron nitride abrasive grain and 50% of the total volume of the abrasive phase silicon carbide abrasive grain.

5. The abrasive article of claim 2 in the form of an abrasive grinding wheel.

6. The abrasive article of claim 3 in the form of an abrasive grinding wheel.

* * * * *